US006237495B1

(12) United States Patent
Hok et al.

(10) Patent No.: US 6,237,495 B1
(45) Date of Patent: May 29, 2001

(54) SELF-DESTRUCTING IMPACT FUSE

(75) Inventors: AW Cheng Hok; EE Guan Soon; Tan Chian Chiow, all of Singapore (SG)

(73) Assignee: Chartered Ammunition Industries PTE LTD, Singapore (SG)

( * ) Notice: Subject to any disclaimer, the term of this patent is extended or adjusted under 35 U.S.C. 154(b) by 0 days.

(21) Appl. No.: 09/449,311

(22) Filed: Nov. 24, 1999

(30) Foreign Application Priority Data

Feb. 4, 1999 (SG) ..... 9900807
Apr. 23, 1999 (SG) ..... PCT/SG99/00064

(51) Int. Cl.[7] ..... F42C 15/196; F42C 15/21; F42C 15/22; F42C 1/00

(52) U.S. Cl. ..... 102/245; 102/245; 102/231; 102/233; 102/234; 102/235; 102/236; 102/237; 102/244; 102/251; 102/252

(58) Field of Search ..... 102/231, 233, 102/234, 235, 236, 237, 244, 245, 251, 252

(56) References Cited

U.S. PATENT DOCUMENTS

| | | | | |
|---|---|---|---|---|
| 791,873 | * | 6/1905 | Brown | 102/234 |
| 988,846 | * | 4/1911 | Abendroth | 102/234 |
| 2,079,394 | * | 5/1937 | Birkigt | 102/234 |
| 2,155,100 | * | 4/1939 | Scelzo | 102/235 |
| 3,585,935 | * | 6/1971 | Birkigt | 102/234 |
| 3,601,059 | * | 8/1971 | Briggs | 102/245 |
| 3,823,669 | * | 7/1974 | Zacharin | 102/245 |
| 3,998,164 | | 12/1976 | Hadfield | 102/81.2 |
| 4,230,042 | * | 10/1980 | Popovitch | 102/233 |
| 4,455,940 | * | 6/1984 | Furuike | 102/228 |
| 4,653,401 | | 3/1987 | Gatti | 102/226 |
| 5,243,912 | * | 9/1993 | Ziemba | 102/235 |
| 5,387,257 | * | 2/1995 | Tari et al. | 102/226 |

FOREIGN PATENT DOCUMENTS

| | | |
|---|---|---|
| 663277 | 11/1987 | (CN) . |
| 663277 A5 | 11/1987 | (CN) . |
| 2918039 | 11/1980 | (DE) . |
| 2918039 A1 | 11/1980 | (DE) . |
| 278837 | 8/1988 | (EP) . |
| 278837 B1 | 8/1988 | (EP) . |
| 681157 | 8/1995 | (EP) . |
| 681157 B1 | 8/1995 | (EP) . |

* cited by examiner

*Primary Examiner*—Michael J. Carone
*Assistant Examiner*—Lulit Semunegus
(74) *Attorney, Agent, or Firm*—Nikolai, Mersereau & Dietz, P.A.

(57) ABSTRACT

A self destructing impact fuse including a cylindrical firing pin having a hollow centrifugal chamber for holding a number of spheres and a number of radial openings on its surface for exposing portions of the spheres when the chamber is spun. At one end of the chamber is a spring for exerting compression force along the longitudinal axis of the chamber and at the other end is a self-destructing (SD) firing pin for striking the detonator. A centrifugal lock having a pivot offset from the longitudinal axis holds the chamber in place by mating with a groove on the surface of the centrifugal chamber. The cylindrical firing pin is seated concentrically within a frame and disposed over an escapement assembly featuring the detonator. The detonator is rotated into alignment with the SD firing pin after the projectile, incorporating the fuse, travels the minimum tactical distance. The frame is further coupled with a base, which features a point detonation (PD) firing pin for striking the detonator.

5 Claims, 5 Drawing Sheets

SELF-DESTRUCTING IMPACT FUSE

The present application is an application filed in accordance with 35 U.S.C. §119 and claims the benefit of earlier filed International application number PCT/SG/99/00064 filed on Apr. 23, 1999 which claims the benefit of Singapore application number 9900807-0 filed on Feb. 4, 1999.

I. FIELD OF THE INVENTION

The present invention relates to a self-destructing impact fuse for ammunition. In particular, the present invention pertains to a fuse for automatically and reliably detonating ammunition delivered by projectile even when the ammunition does not explode upon impact.

II. BACKGROUND OF THE INVENTION

Self-destructing impact fuses are employed to detonate ammunition delivered by projectiles when the ammunition fails to explode upon impact. There are a variety of reasons why ammunition fails to explode upon impact: First, it misses the target and lands on soft grounds such as a swamp or a snow covered area; or secondly it lands on a suboptimal angle with respect to the point of impact. Unexploded ammunition poses hazards for the civilians and the military alike and operation to remove such unexploded ammunition is dangerous, costly and labor intensive.

Prior art self-destructing impact fuses can be generalized into three categories: (1) chemical, (2) mechanical and (3) electronic. Exemplary of a chemical self-destructing delay impact is U.S. Pat. No. 3,998,164 issued to Hadfield. The '164 patent describes a self-destructing fuse illustrating the use of a timing chamber containing liquid in combination with a weight and tubular spring mechanism for releasing the firing pin onto the detonator.

An example of a mechanical self-destructing fuse for sub-munition is U.S. Pat. No. 4,653,401 issued to Gatti. The '401 patent relies on the plastic deformation of a wire element which holds and delays the exertion of a secondary striker member onto the detonator.

Recently, electronic self-destructing fuses have also been developed to detonate projectiles via electronic timing circuitry after they fail to explode upon impact. The present invention avoids the deficiencies of the prior art, which will become apparent to those skilled in the art from a review of the description of the present invention.

OBJECT OF THE INVENTION

It is an object of the present invention to enhance the reliability of a self-destructing fuse without significantly increasing the unit production cost thereof.

It is another object of the present invention to incorporate into a self-destructing impact fuse key components, which respond to physical forces exerted on the ammunition and during the flight of projectile.

SUMMARY OF THE INVENTION

The present invention includes a cylindrical firing pin having a hollow centrifugal chamber for holding a number of spheres and a number of radial openings on its surface for exposing portions of the spheres when the chamber is spun. At one end of the chamber is a spring for exerting a compression force along the longitudinal axis of the chamber and at the other end is a self-destructing (hereinafter referred to as "SD") firing pin for striking the detonator. A centrifugal lock having a pivot, offset from the longitudinal axis, holds the chamber in place by mating with a groove on the surface of the centrifugal chamber. The cylindrical firing pin is seated concentrically within a frame and disposed over an escapement assembly featuring the detonator. The detonator is rotated into alignment with the SD firing pin after the projectile incorporating the fuse travels a minimum tactical distance. The frame is further coupled to a base, which features a point detonation (hereinafter referred to as "PD") firing pin for striking the detonator.

DETAILED DESCRIPTION OF THE INVENTION

A self-destructing impact fuse for a projectile containing explosive is described. In the following description, numerous specific details are set forth herein, including specific details related to the centrifugal chamber and firing pin, in order to provide a thorough understanding of the present invention. It will be obvious to one skilled in the art that the specific details of the present invention may be modified without imparting from the scope of the present invention. In other instances, the description of well-known parts, such as those involved with explosive charges and the external structure of a projectile, is omitted in order not to obscure the description of the present invention.

Figure 1A:
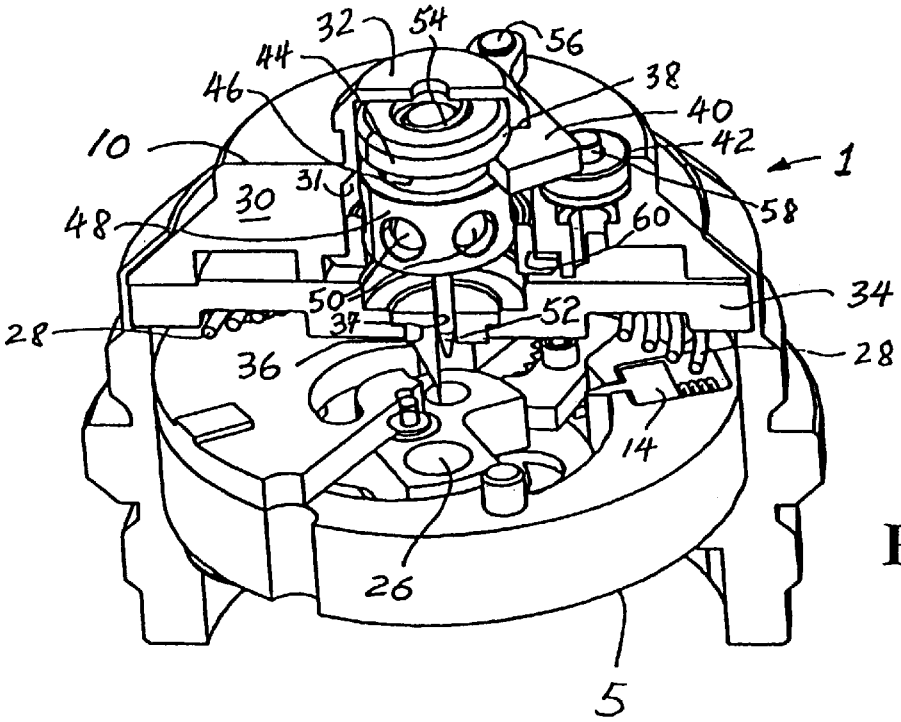
FIG. 1A is a partial sectional perspective view of the present invention, showing it being in a "SAFE" position and prior to the projectile being propelled through the muzzle.
Figure 1B:
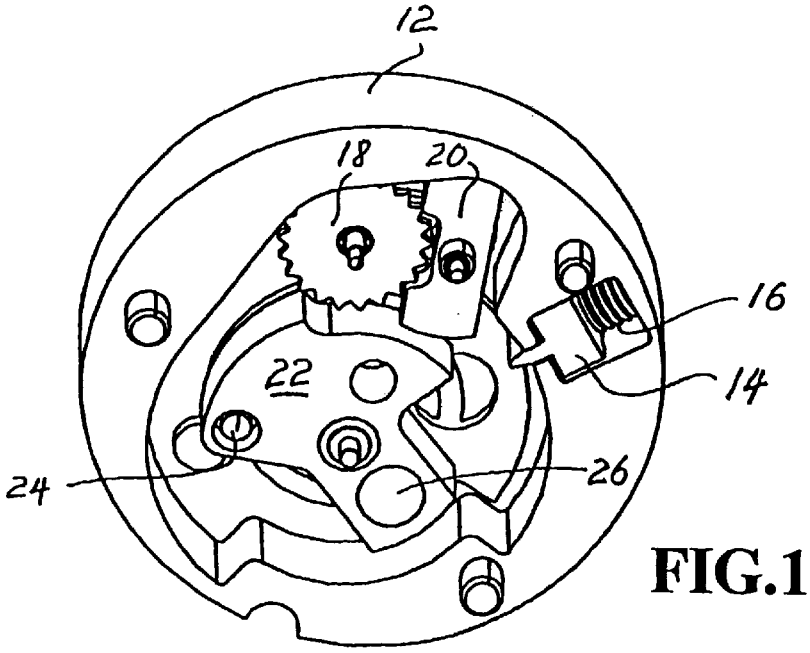
FIG. 1B is a bottom perspective view of the escapement assembly of the projectile of the type shown in FIG. 1A.

FIG. 1A is a perspective, partial cut away, elevational view of the present invention, showing it being in a "SAFE" position and prior to the projectile being propelled through the muzzle. The self-destructing impact fuse 1 of the present invention is a mechanical fuse for initiating explosive charge upon impact of the projectile. Fuse 1 comprises an escapement assembly 5 and a self-destructing fuse 10 separated by a conical spring 28. FIG. 1B is a bottom, perspective, elevational view of the escapement assembly of the projectile according to FIG. lA. The escapement assembly 5 comprises a body 12, a detent 14, a spring 16, a pinion assembly 18, a verge assembly 20 and a rotor assembly 22 for aligning the detonator after a predetermined interval. It should be understood by those skilled in the art that the escapement assembly 5 alone but not in conjunction with the fuse of the present invention has been used previously and thus the escapement assembly alone is not claimed by the applicant in the present invention. The rotor assembly 22 further comprises an arming lock pin 24 and a detonator 26.

Referring again to FIG. 1A, the self-destructing fuse 10 comprises a frame 30 having an enclosure 32, a base 34, a self-destructing (SD) firing pin subassembly 38, a centrifugal lock 40, a self-destructing (SD) setback pin subassembly 42 and a support ring 60. The frame 30 and the enclosure 32 constitute the upper portion of the self-destructing fuse and the base 34 constitutes the bottom portion of the self-destructing fuse. A point detonation (PD) firing pin 36 is disposed near the center of the base 34 for initiating the explosive charge once the projectile impacts the target. At the same time, a self-destructing (SD) firing pin opening 37 of the pin 36 permits the SD firing pin subassembly 38 to be lowered there through when the projectile fails to explode upon impact (to be described in detail with respect to FIGS. 5 and 6).

The SD firing pin subassembly 38 comprises a self-destructing (SD) spring 54, a SD head 44, a SD groove 46, a SD centrifugal chamber 48 and a SD firing pin 52. The SD firing pin subassembly 38 is disposed within an opening 31 of the frame 30 for providing fail safe detonation of the explosive charge of the projectile should the projectile fail to explode for reasons identified above in the background of the invention section. The SD centrifugal chamber 48 is hollow and holds a plurality of spheres 50; the chamber further communicates with a plurality of radial openings 49 disposed on the surface of the chamber 48. When the projectile and the chamber is subjected to centrifugal force, the spheres 50 will be pushed outwards and a portion of the sphere thereof is exposed through the radial openings 49. Disposed between the SD head 44 and the SD centrifugal chamber 48 is the SD groove 46 for the purpose of receiving the centrifugal lock 40. The centrifugal lock 40 has a pivot 56 offset from the longitudinal axis of the frame 30; the centrifugal lock 40 locks the SD firing pin subassembly 38 in place with the assistance of the SD setback pin subassembly 42. The SD setback pin subassembly 42 comprises a SD setback pin 58 and a spring 62 (not shown in any of the figures).

FIGS. 1A and 1B show the unaligned "SAFE" position of the self-destructing fuse 10 when the projectile has not yet been launched. When in the "safe" position, the detent 14 locks the rotor assembly 22 in place, while the SD setback pin subassembly 42 also locks the centrifugal lock 40 against the SD firing pin subassembly.

Figure 2A:
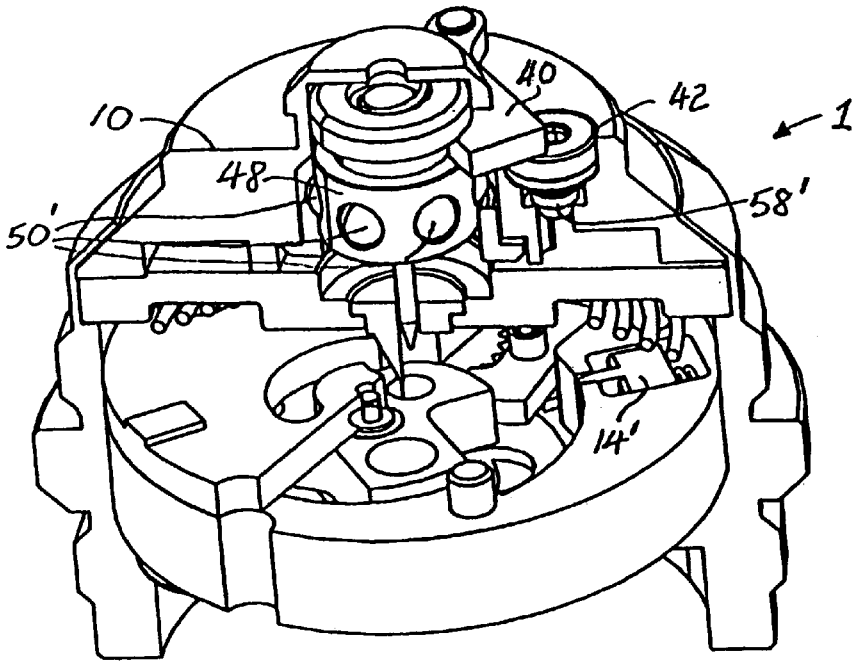
FIG. 2A is a partial sectional perspective view of the present invention, showing the retraction of the setback pin during the initial launch of the projectile.
Figure 2B:
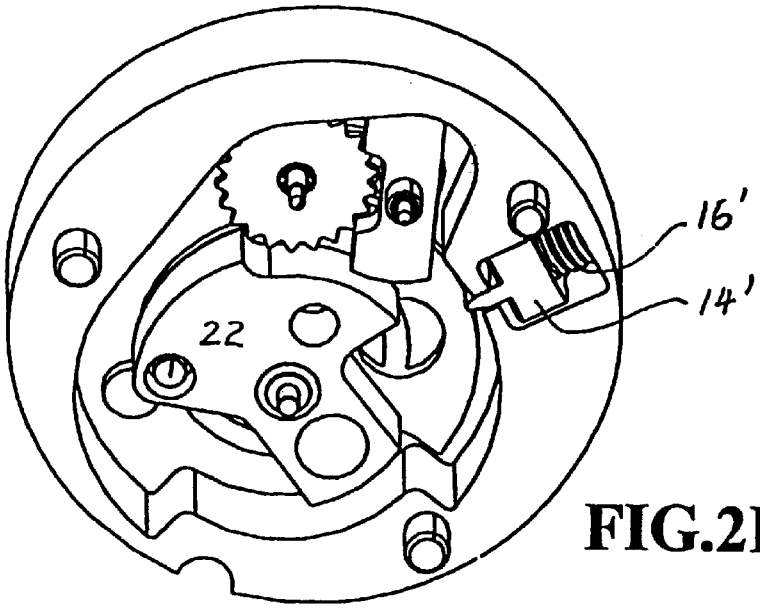
FIG. 2B is a bottom perspective view of the escapement assembly of the projectile, showing retraction of the detent and initiation of the timing function of the fuse.

FIG. 2A is a perspective, partial cut away, elevational view of the present invention, showing the retraction of the SD setback pin during the initial launch of the projectile. Once the projectile is subjected to a setback force, the spring 62 (not shown) of the SD setback pin subassembly 42 is deflected allowing the SD setback pin 58' to retract. At the same time the projectile is subjected to a setback force, a centrifugal force (resulting from the projectile rotating its way through the rifled gun barrel and out of the muzzle) is exerted on the SD centrifugal lock 40 and the SD spheres 50'. Centrifugal Lock 40 loses its contact with SD groove 46 and moves over the SD setback pin subassembly 42, while the spheres 50' within the SD centrifugal chamber move outwards inside the radial openings 49 shown in the drawing. The spheres 50' are urged against the support ring 60 such that the SD firing pin subassembly 38 remains unchanged in its position; therefore, the fuse remains secured and barrel safety is assured. The centrifugal force also acts on the detent 14' and the spring 16' such that they retract and allow the rotor assembly 22 of the escapement assembly in FIGS. 2A and 2B to initiate the arming sequence.

Figure 3A:
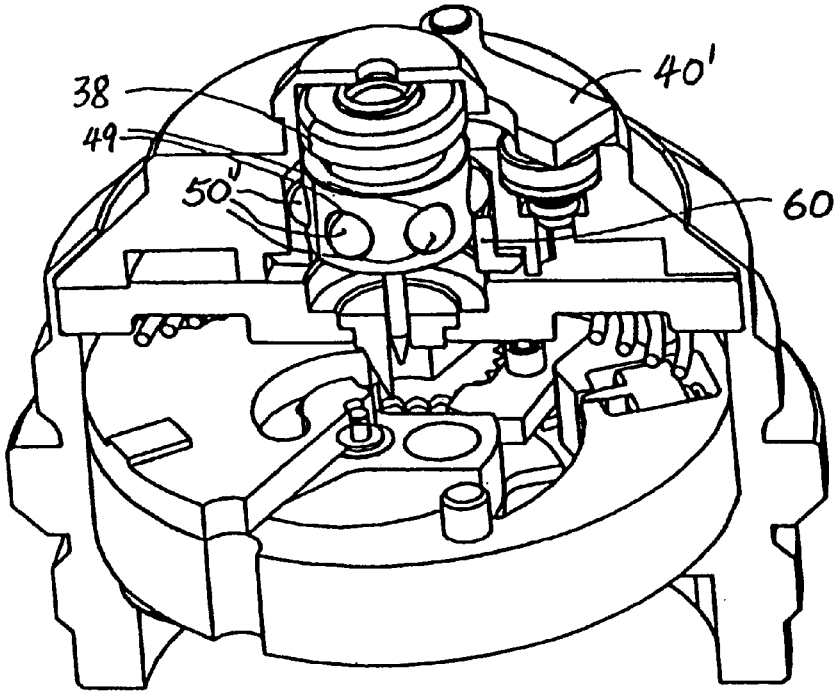
FIG. 3A is a partial sectional perspective view of the present invention, showing the full extent of the centrifugal lock and of the centrifugal balls at the maximum acceleration of the projectile.
Figure 3B:
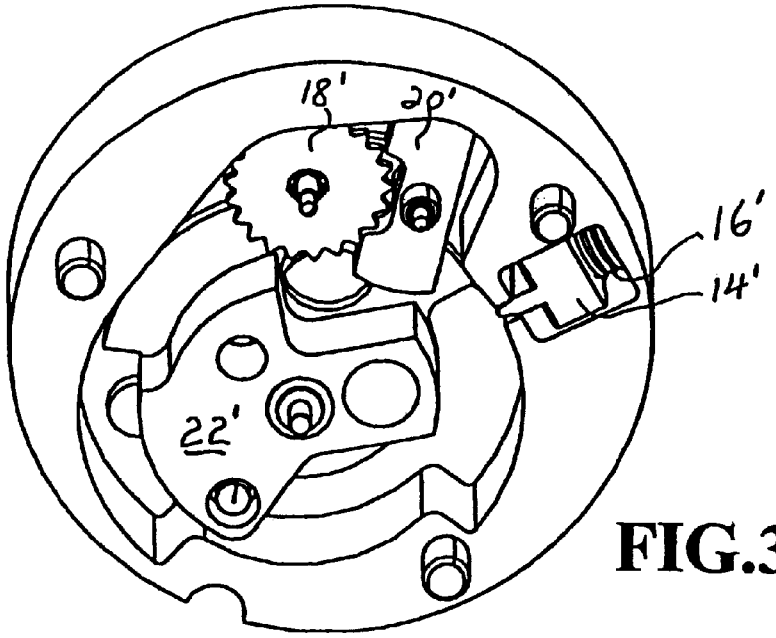
FIG. 3B is a bottom perspective view of the escapement assembly of the projectile, showing the gradual alignment of the rotor assembly into an "ARMED" position.

FIG. 3A is a perspective, partial cut away, elevational view of the present invention, showing the fuse as the projectile reaches maximum acceleration. Here, the centrifugal lock 40' is fully retracted and the spheres 50" fully extended through the radial openings 49. In combination with the contact with the support ring 60, the spheres 50" are able to overcome the compression force exerted axially by the SD spring 54' on the SD firing pin subassembly. FIG. 3B is a bottom, perspective, elevational view of the escapement assembly of the projectile, showing the gradual alignment of the rotor assembly into an "ARMED" position. Under the influence of radially acting centrifugal forces, the detent 14' and spring 16' continue to be retracted and the rotor assembly 22' rotates into position. The pinion assembly 18' and the verge assembly 20' prevent the rotor assembly 22' from rotating to the "ARMED" position until after the prescribed arming delay time is reached.

Figure 4A:
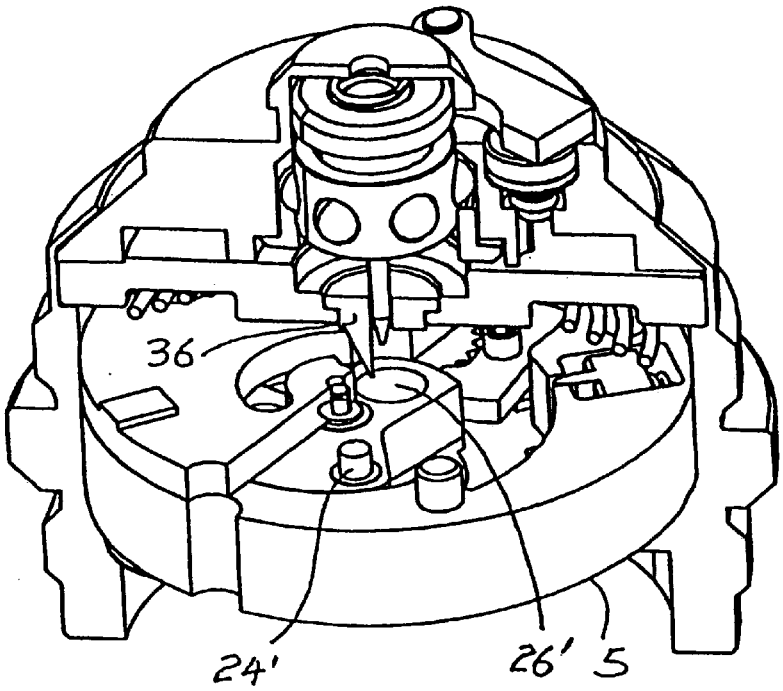
FIG. 4A is a partial sectional perspective view of the present invention, showing the alignment of the point detonation (PD) firing pin with the detonator and full extent of the arming lock pin.
Figure 4B:
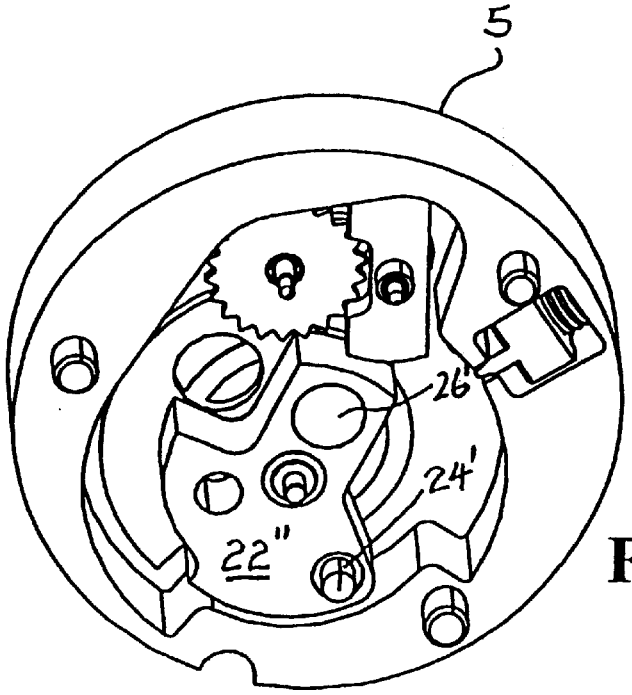
FIG. 4B is a bottom perspective view of the escapement assembly of the projectile, showing the extension of the arming lock pin, thereby locking the rotor in the "ARMED" position.

FIG. 4A is a perspective, partial cut away, elevational view of the present invention, showing the alignment of the point detonation (PD) firing pin 36 with the detonator 26' and full extent of the arming lock pin 24'. The rotor assembly 22" is shown to align the detonator 26' directly over the PD firing pin. In FIG. 4B, the escapement assembly of the projectile shows the extension of the arming lock pin 24'. Here, the projectile has traveled beyond the muzzle safety distance and before the tactical distance. The arming lock pin 24' prevents the rotor assembly 22" from unarming itself when it fails to hit the target and lands on a soft ground. Thus, the self-destructing fuse 10 is armed. Should the projectile impact the target, the escapement assembly 5 accelerates towards the frame. As the detonator 26' is aligned with the PD firing pin 36, it detonates the explosive charge.

Figure 5:
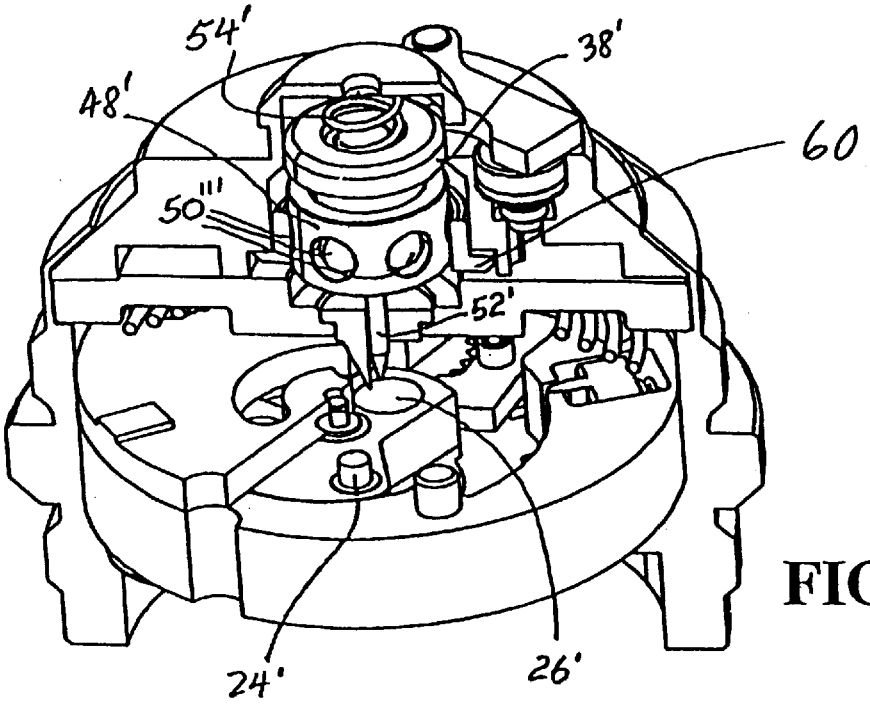
FIG. 5 is a partial sectional perspective view of the present invention, showing the lowering of the self-destructing (SD) firing pin onto the detonator when the self-destructing (SD) spring overcomes the centrifugal force acting on the centrifugal balls.
Figure 6:
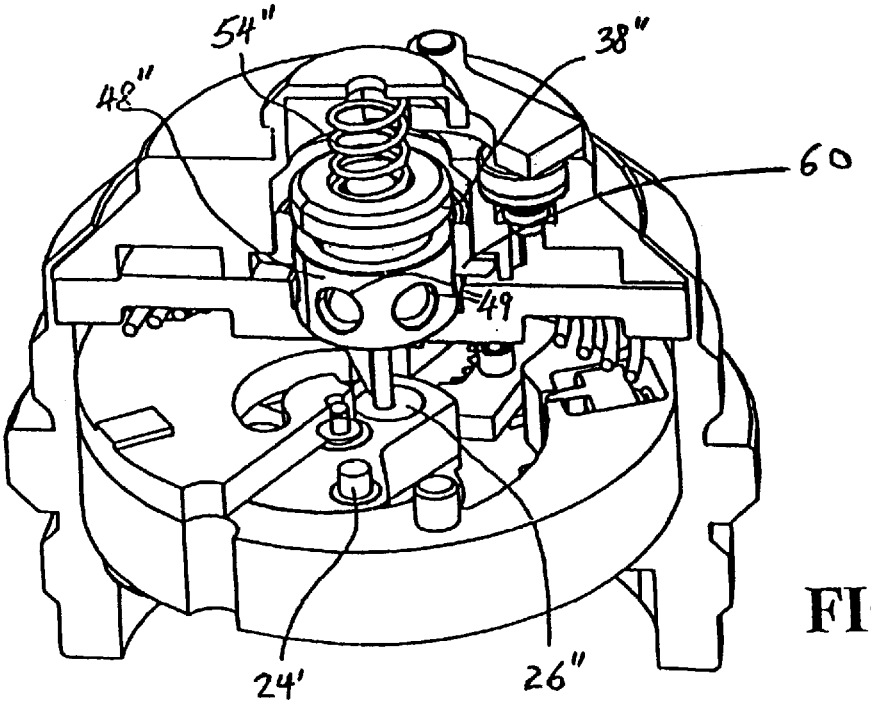
FIG. 6 is a partial sectional perspective view of the present invention, showing the self-destructing (SD) firing pin striking the detonator of the escapement assembly.

FIGS. 5 and 6 describe the sequence of detonation of the present invention when the projectile fails to explode upon impact and reaches the maximum tactical distance. Due to resistance of the air, the rotational speed of the projectile decreases continuously throughout its flight. At the same time that the rotational speed of the projectile decreases continuously, the centrifugal force acting on the fuse 10 is reduced continuously. After a certain flight time, the force exerted by the SD spring 54' on the SD firing pin subassembly in FIGS. 5 and 6 is greater than that of the centrifugal force acting on the spheres 50'". The spheres 50'" retract from the support ring 60 via the radial openings 49 (see FIG. 5). Once the spheres 50'" retract, the SD firing pin subassembly 38" and the SD firing pin 52" are lowered onto the detonator 26" and set off the explosive charge (see FIG. 6).

The present invention as described in FIGS. 1–6 requires few components and thus results in a compact design for a self-destructing impact fuse. Furthermore, the SD firing pin subassembly used in combination with the SD setback pin subassembly ensure that each of the components interact responsively with the physical forces (whether it is an acceleration, deceleration and/or centrifugal force) exerted on the fuse. As such, the self-destructing fuse of the present invention is reliable. Moreover, each of the components of the present invention is mechanical and may be used extensively. Therefore, the unit cost of production of the present invention can be minimized.

While the preferred embodiment of the present invention shows a SD firing pin subassembly with a hollow centrifugal chamber and a plurality of spheres, it should be understood that other equivalent configurations are possible. For instance, a plurality of radiating flaps disposed on the centrifugal chamber can be used instead of the spheres to prevent the SD firing pin subassembly from being lowered onto the detonator.

Those skilled in the art will appreciate that the present invention may be embodied in other specific forms without departing from the spirit or essential characteristics thereof. The presently disclosed embodiments are, therefore, to be considered in all respects as illustrative and not restrictive, the scope of the invention being indicated by the claims and all modifications, which come within the meaning and range of equivalency of the claims, are, therefore, to be embraced therein.

What is claimed is:

1. A self-destructing impact fuse for a projectile including an escapement assembly for detonating explosive charge coupled thereto, said escapement assembly further comprising at least a rotor assembly and a detonator for aligning said detonator with a point detonation (PD) firing pin, said self-destructing impact fuse comprising:

(a) a frame;

(b) a self-destructing (SD) firing pin assembly disposed concentrically within said frame for detonating said detonator after said PD firing pin fails to detonate said detonator, said SD firing pin assembly further comprising a SD head on one end for receiving a SD spring, a SD firing pin on the opposite end for striking said detonator, and a centrifugal chamber for holding a plurality of spheres therein, said chamber further communicating with a plurality of radial openings and exposing a portion of said spheres when the fuse rotates;

(c) a groove disposed on the surface of said SD firing pin assembly for receiving a centrifugal lock, said lock having a pivot offset from the longitudinal axis of said frame;

(d) a setback pin assembly controlling the release of said centrifugal lock from said SD firing pin assembly, said setback assembly having a setback pin retractable upon experiencing acceleration of said projectile; and (e) a support ring disposed concentrically within said frame for balancing the forces exerted radially on said centrifugal chamber with forces exerted axially on said SD firing pin assembly by said SD spring, whereby said support ring prevents said SD firing pin assembly from being lowered onto said detonator when centrifugal forces on said projectile push said spheres against said ring and said SD spring lowers said SD firing pin assembly onto said detonator when the compression forces overcome the centrifugal forces on said spheres.

2. A self-destructing impact fuse as recited in claim 1, wherein said centrifugal chamber is hollow and cylindrical.

3. A self-destructing impact fuse as recited in claim 1, wherein said spheres are radiating flaps.

4. A self-destructing impact fuse as recited in claim 1, wherein the number of said spheres is the same as the number of said radial openings.

5. A self-destructing impact fuse as recited in claim 1, wherein said groove is disposed between said SD head and said centrifugal chamber.

* * * * *